US012329262B2

(12) United States Patent
Holmes-Del Masto et al.

(10) Patent No.: US 12,329,262 B2
(45) Date of Patent: Jun. 17, 2025

(54) NONWOVEN MATERIAL FOR COSMETIC CUSHION COMPACT

(71) Applicant: ELC Management LLC, Melville, NY (US)

(72) Inventors: Olivia Holmes-Del Masto, Centereach, NY (US); Pamela Wong-Putnam, Greenlawn, NY (US); Sezen Buell, Harrington Park, NJ (US)

(73) Assignee: ELC Management LLC, Melville, NY (US)

( * ) Notice: Subject to any disclaimer, the term of this patent is extended or adjusted under 35 U.S.C. 154(b) by 903 days.

(21) Appl. No.: 17/390,955

(22) Filed: Jul. 31, 2021

(65) Prior Publication Data

US 2023/0041915 A1 Feb. 9, 2023

(51) Int. Cl.
*A45D 33/34* (2006.01)
*D01F 8/06* (2006.01)
(Continued)

(52) U.S. Cl.
CPC ..... *A45D 33/34* (2013.01); *D01F 8/06* (2013.01); *D01F 8/14* (2013.01); *D04H 1/4291* (2013.01); *D04H 1/435* (2013.01); *D04H 1/43828* (2020.05); *A45D 2200/1009* (2013.01); *D10B 2321/021* (2013.01); *D10B 2331/04* (2013.01);
(Continued)

(58) Field of Classification Search
None
See application file for complete search history.

(56) References Cited

U.S. PATENT DOCUMENTS 5,357,987 A 10/1994 Schrepf
7,171,969 B2 2/2007 Gueret
(Continued)

FOREIGN PATENT DOCUMENTS

JP H07313247 12/1995
JP 2021-164528 A 10/2021
(Continued)

OTHER PUBLICATIONS

PCT International Search Report; International Application No. PCT/US2022/050642; Completion Date: Apr. 25, 2023; Mailing Date: Apr. 25, 2023.
(Continued)

*Primary Examiner* — Arti Singh-Pandey
(74) *Attorney, Agent, or Firm* — Kirby Drake

(57) ABSTRACT

A nonwoven material formed of bicomponent fibers may be used as a cosmetic cushion to hold cosmetic compositions, such as liquid foundation, in a housing for consumer use with an applicator. The use of bicomponent fibers may allow for the utilization of various natural or synthetic materials for the core and shell which may be adjusted for greatest compatibility with cosmetic compositions. Bicomponent fibers forming nonwoven materials may be a polyethylene terephthalate (PET) core/polyethylene (PE) shell composition. This PET/PE composition may allow for maximum stability and chemical resistance in combination with aggressive chemical ingredients. Cosmetic cushions using these nonwoven materials may feel sensationally pleasing to the consumer and perform with the best quality throughout the lifetime of the product. The cosmetic cushion also may look aesthetically pleasing when filled or saturated with product.

18 Claims, 9 Drawing Sheets

(51) Int. Cl.

| | |
|---|---|
| ***D01F 8/14*** | (2006.01) |
| ***D04H 1/4291*** | (2012.01) |
| ***D04H 1/435*** | (2012.01) |
| ***D04H 1/4382*** | (2012.01) |

(52) U.S. Cl.
CPC .. *D10B 2401/046* (2013.01); *D10B 2401/062* (2013.01); *D10B 2509/00* (2013.01)

(56) References Cited

U.S. PATENT DOCUMENTS

| | | | |
|---|---|---|---|
| 9,271,557 | B2 | 3/2016 | Corbellini et al. |
| 9,545,143 | B1 | 1/2017 | Jacob et al. |
| 2004/0226573 | A1 | 11/2004 | Gueret |
| 2020/0063302 | A1 | 2/2020 | Okumura et al. |
| 2020/0071855 | A1 | 3/2020 | Zhao et al. |
| 2020/0170374 | A1 | 6/2020 | Que et al. |
| 2021/0307489 | A1 | 10/2021 | Butcher |

FOREIGN PATENT DOCUMENTS

| | | | |
|---|---|---|---|
| KR | 10-1923187 | B1 | 11/2018 |
| KR | 10-2203954 | B1 | 1/2021 |

OTHER PUBLICATIONS

PCT Written Opinion of the International Searching Authority; International Application No. PCT/US2022/050642; Completion Date: Apr. 25, 2023.

PCT International Search Report; International Application No. PCT/US2022/038732; Completion Date: Nov. 17, 2022; Mailing Date: Nov. 18, 2022.

PCT Written Opinion of the International Searching Authority; International Application No. PCT/US2022/038732; Completion Date: Nov. 17, 2022.

Taiwan IPO Search Report from TW Application No. 111128647; Date: Mar. 8, 2023.

PET/PE

ECM

NONWOVEN MATERIAL FOR COSMETIC CUSHION COMPACT

FIELD OF THE DISCLOSURE

The present disclosure generally relates to nonwoven materials, and more particularly to nonwoven materials for cosmetic cushion compacts.

BACKGROUND

Cosmetic foundations are typically contained within a compact having a substrate, typically a cushion, that may retain a liquid cosmetic composition. Substrates have been formed from polyethylene foam, polyurethane foam, nitrile butyl or sponge rubber, or foam. However, these substrates may suffer from various drawbacks. For example, polyurethane foam is limited to cosmetic compositions having a rather narrow viscosity profile. Products that are too thin are not retained by the foam, and products that are too thick may not effectively be injected into the foam. In another instance, certain formulations cannot be injected into polyurethane foam, nitrile butyl rubber, and similar materials because they are incompatible with them, such as with formulations containing organic sunscreen actives. They may absorb ultraviolet actives, resulting in products which do not exhibit sufficient sun protection factor (SPF) upon use. Alternative materials, such as synthetic nonwoven fibers, have been employed as substrates for cosmetic fibers. However, these types of nonwoven fibers have been less capable of absorbing, retaining, and uniformly dispensing cosmetic compositions.

SUMMARY

Embodiments of the present disclosure may provide a cosmetic cushion to hold a cosmetic composition, the cushion comprising: a nonwoven material formed of bicomponent fibers having a fiber diameter range of 5-40 μm, preferably 18-30 μm, wherein distribution of the cosmetic composition on the cosmetic cushion formed of the nonwoven material remains more stable throughout use compared to a cushion formed of non-microfiber. The bicomponent fibers may be selected from the group comprising but not limited to: a polyethylene terephthalate (PET) core/polyethylene (PE) shell composition, a polypropylene (PP)/polypropylene (PP) composition, a polypropylene (PP)/polyethylene (PE) composition, a polyethylene terephthalate (PET)/polypropylene (PP) composition, and blends thereof. The nonwoven material may be formed at least in part of fibers from virgin resin or recycled resin. The cushion may have a thickness of approximately 2 mm-20 mm, preferably 5 mm-15 mm, and a diameter of approximately 20-100 mm. The cushion may include one or more binder fibers added to the nonwoven material.

The nonwoven material may be formed of bicomponent fibers that may comprise a polyethylene terephthalate (PET) core/polyethylene (PE) shell composition. The nonwoven material may have a density of 20-35 kg/m^3. The density and the fiber diameter of the nonwoven material may be lower than a cosmetic cushion formed of non-microfiber. The density of the nonwoven material may be higher than a cosmetic cushion formed of polyurethane. The nonwoven material may have a sorptivity of 0.0900 g/m^2t^5. The sorptivity of the nonwoven material may be higher than a cosmetic cushion formed of non-microfiber. The cushion may have a compressive distance by application of 6 N force that is approximately the same for a dry cushion as with a cushion filled with the cosmetic composition.

Other embodiments of the present disclosure may provide a cosmetic cushion to hold a cosmetic composition, the cushion comprising: a nonwoven material formed of bicomponent fibers having a polyethylene terephthalate (PET) core/polyethylene (PE) shell composition having a fiber diameter range of 5-40 μm, preferably 18-30 μm. The distribution of the cosmetic composition may remain stable between 100 and 200 pressings of the cushion formed of the nonwoven material. This reflects that distribution of the cosmetic composition on the cosmetic cushion formed of the nonwoven material according to embodiments of the present disclosure remains more stable throughout use compared to a cushion formed of non-microfiber. A density and the fiber diameter of the nonwoven material may be lower than a cosmetic cushion formed of non-microfiber. A density of the nonwoven material may be higher than a cosmetic cushion formed of polyurethane. A sorptivity of the nonwoven material may be higher than a cosmetic cushion formed of non-microfiber.

Further embodiments of the present disclosure may provide a cosmetic cushion to hold a cosmetic composition, the cushion comprising: a nonwoven material formed of bicomponent fibers selected from the group comprising, but not limited to: a polyethylene terephthalate (PET) core/polyethylene (PE) shell composition, a polypropylene (PP)/polypropylene (PP) composition, a polypropylene (PP)/polyethylene (PE) composition, a polyethylene terephthalate (PET)/polypropylene (PP) composition, and blends thereof, wherein the cosmetic cushion may have a compressive distance by application of 6 N force that is approximately the same for a dry cushion as with a cushion filled with the cosmetic composition. A density and a fiber diameter of the nonwoven material may be lower than a cosmetic cushion formed of non-microfiber, and a sorptivity of the nonwoven material may be higher than a cosmetic cushion formed of non-microfiber.

Other technical features may be readily apparent to one skilled in the art from the following figures, descriptions and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
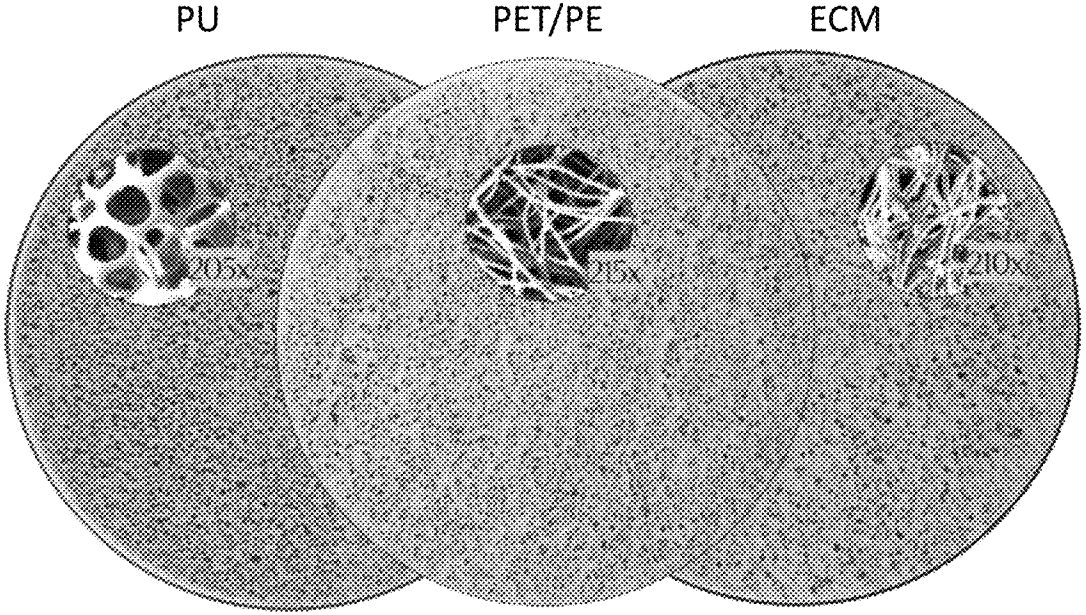
FIG. 1 depicts an aesthetic appearance of filled cosmetic cushions with scanning electron microscope (SEM) images according to an embodiment of the present disclosure.

Embodiments of the present disclosure may provide a nonwoven material formed of bicomponent fibers that may be used as a cosmetic cushion to hold cosmetic compositions, such as liquid foundation, in a housing for consumer use with an applicator. Nonwoven materials according to embodiments of the present disclosure may optimize material structure and aesthetics for use with a variety of compositions. Cosmetic cushions using nonwoven materials according to embodiments of the present disclosure may feel sensationally pleasing to the consumer and perform with the best quality throughout the lifetime of the product. The cosmetic cushion also may look aesthetically pleasing when filled or saturated with product.

Nonwoven materials are random entanglements of various fiber types, such as bicomponent fibers, formed by carding, cross-lapping, and/or bonding methods including, but not limited to, thermal bonding, needle punching, and/or hydroentangling. The use of bicomponent fibers in embodiments of the present disclosure may allow for the utilization of various natural or synthetic materials for the core and shell which may be adjusted for greatest compatibility with cosmetic compositions. Bicomponent fibers forming nonwoven materials according to embodiments of the present disclosure may include polyethylene terephthalate (PET) core/polyethylene (PE) shell composition. This PET/PE composition may allow for maximum stability and chemical resistance in combination with aggressive chemical ingredients as discussed in more detail herein. While nonwoven materials having a PET/PE composition are described in embodiments of the present disclosure, other combinations of materials, including, but not limited to, polypropylene (PP)/polypropylene (PP), polypropylene (PP)/polyethylene (PE), polyethylene terephthalate (PET)/polypropylene (PP) and their blends thereof may be used without departing from the present disclosure. It should be appreciated that binder fibers that melt at higher or lower temperatures can be added to alter the structure without departing from the present disclosure.

As reflected, for example, through the analyses described herein, a cosmetic cushion formed of nonwoven microfiber, such as PET/PE material, may be preferred aesthetically and sensationally by the consumer. A microfiber die cut material for cosmetic cushions according to embodiments of the present disclosure may retain formulations best with a 200-400 gsm basis weight and 250-400 cfm air permeability. Cosmetic cushion material according to embodiments of the present disclosure may be approximately 2 mm-20 mm in thickness, preferably 5 mm-15 mm, and approximately 20-100 mm in diameter. It should be appreciated that the materials forming a cosmetic cushion according to embodiments of the present disclosure may be circular; however, the materials, or the cushion itself, may assume other shapes without departing from the present disclosure. It also should be appreciated that nonwoven materials according to embodiments of the present disclosure may be made of fibers from virgin resin or recycled resin in order to be more sustainable.

Various experimental analyses were performed to evaluate the resilience and absorbency of the PET/PE nonwoven materials according to embodiments of the present disclosure. These analyses were performed by adjusting fiber material, diameter, cross-sectional shape, rigidity, as well as fiber binding, basis weight and other process parameters used in manufacturing. The PET/PE nonwoven material allows for a balance of rigidity from PET and softness from PE resulting in a more consistent structure throughout use. Additionally, a small fiber diameter, such as microfiber, was chosen to create larger pores and increase porosity and sorptivity. The PET/PE analyses were compared to existing polyurethane (PU) foam and existing cosmetic materials (ECM) (i.e., non-microfibers). Characterization of the various cosmetic cushion materials included evaluation of fiber diameter (if applicable), density, as well as sorptivity. The material specifications for PET/PE, PU, and ECM are set forth in Table 1.

TABLE 1

Material Specifications

| Material | Fiber Diameter μm | Density $\left(\frac{kg}{m^3}\right)$ | Sorptivity $\left(\frac{g}{m^2t^{.5}}\right)$ |
|---|---|---|---|
| PU | — | <20 | 0.11 ± 0.05 |
| ECM | 30-34 | >35 | 0.03 ± 0.05 |
| PET/PE | 18-30 | 20-35 | 0.09 ± 0.05 |

Fiber diameters for the various materials were evaluated using scanning electron microscopy (SEM). FIG. 1 depicts an aesthetic appearance of filled cosmetic cushions with SEM images according to an embodiment of the present disclosure. The PET/PE material has a fiber diameter range of 18-30 μm for 20-35 kg/m^3 density as reflected in Table 1 above. As reflected in Table 1, PET/PE material according to embodiments of the present disclosure has greater density than the PU foam and greater sorptivity than the ECM allowing the material to hold higher viscosity products. Similarly, the sorptivity, or the capacity of material to absorb water by capillary action, of the PET/PE microfiber material is greater than ECM and more like PU.

Figure 2:
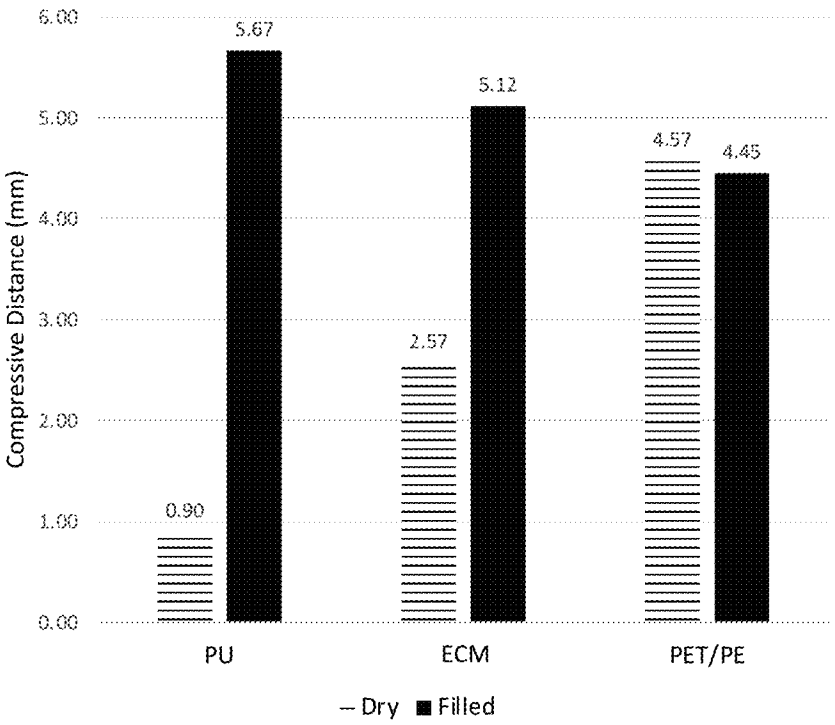
FIG. 2 depicts a graphical comparison of compressive distance by application of 6 N force for dry versus filled/saturated material according to an embodiment of the present disclosure.

To evaluate the resiliency of the various cosmetic cushion materials, compression and recovery also were evaluated. Compressive distance by application of 6 N force over the entire surface area of the die cut material was evaluated in comparison of dry versus filled/saturated material for PU, ECM, and PET/PE. FIG. 2 depicts a graphical comparison of compressive distance by application of 6 N force for dry versus filled/saturated material according to an embodiment of the present disclosure. As reflected in FIG. 2, the compressive distances (in millimeters) for dry and filled/saturated PET/PE material were most like one another (4.57 mm versus 4.45 mm) as compared to PU (0.90 mm versus 5.67 mm) and ECM (2.57 mm versus 5.12 mm). Given the similarity in compressive distances for the PET/PE material, a consumer may experience more consistent performance of a cushion formed of PET/PE material according to embodiments of the present disclosure through the entire product life cycle (i.e., as the cushion is evacuated) as compared to cushions formed of PU material or ECM.

Central location testing and simulated consumer review confirmed that PET/PE material according to embodiments of the present disclosure performed better on consistency of amount of product picked up or loaded with each pressing compared to PU material or ECM. The foundation distribution remained stable between 100 and 200 pressings of a cushion formed of PET/PE material. Accordingly, distribution of the cosmetic composition on the cosmetic cushion formed of PET/PE material remains more stable throughout use compared to a cushion formed of non-microfiber. The testing reflected that PET/PE material had a smaller change on amount of product picked up with each pressing, indicating a better performance on consistency of amount picked up when compared to PU material or ECM.

Figure 3:
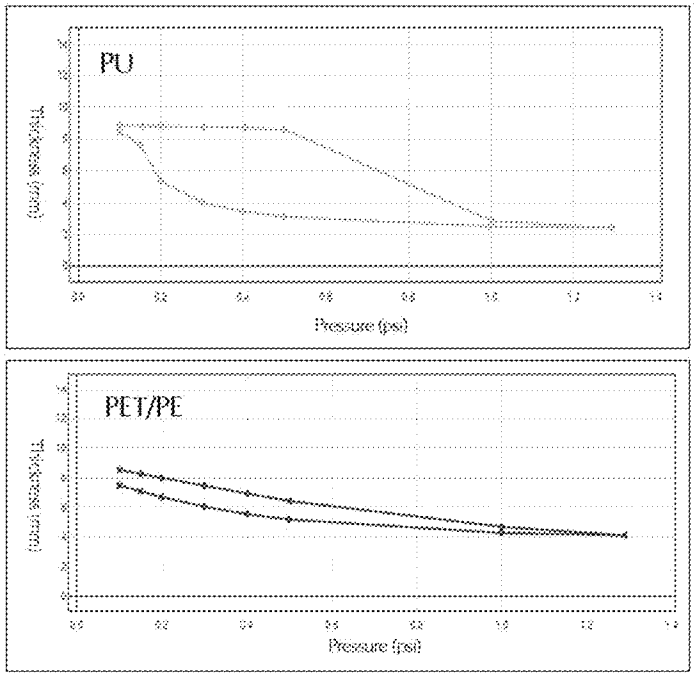
FIG. 3 depicts cosmetic material hysteresis curves according to an embodiment of the present disclosure.

Recovery, or the memory of the cosmetic cushion to return to its original thickness, for the PU and PET/PE materials was measured using the Thwing-Albert Compression/Softness Instrument. Compression and recovery may be recorded in the form of a hysteresis. FIG. 3 depicts cosmetic material hysteresis curves for PU and PET/PE materials according to an embodiment of the present disclosure. As depicted herein, the curve begins by measuring the change in thickness (measured in millimeters) of the material as pressure is applied (1.5 psi/17.5 N force). The thickness change may continue to be measured as pressure is released, and the cushion formed of the material returns to its original thickness. The curves depicted in FIG. 3 reflect that the PU material has a larger area between the compression and recovery representing the "soft" feel and gradual recovery time. In contrast, the hysteresis of PET/PE represents an immediate and identical recovery to the compression (i.e., PET/PE is more consistent than PU material).

Figure 4:
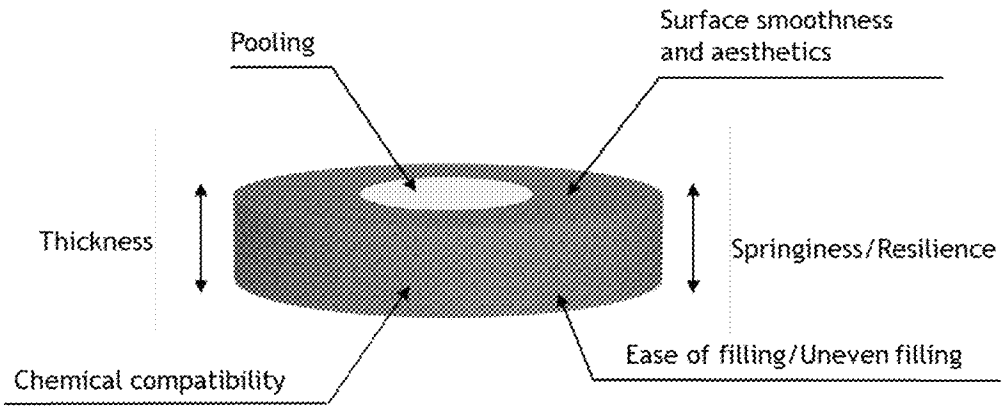
FIG. 4 depicts cosmetic cushion compatibility characteristics according to an embodiment of the present disclosure.

FIG. 4 depicts cosmetic cushion compatibility characteristics according to an embodiment of the present disclosure. More specifically, FIG. 4 depicts where pooling of cosmetic may be evaluated within a cushion. Thickness and springiness/resilience also may be measured along with surface smoothness and aesthetics, chemical compatibility, and/or ease of filling/uneven filling in embodiments of the present disclosure. For example, the behavior of the cosmetic cushions saturated with sunscreen ingredients was evaluated by conditioning materials for a total of four weeks. Samples of each type were conditioned at 50° C. to be compared to room temperature samples. All three of these materials (PU, PET/PE, and ECM) retained material memory and absorbency. Some incompatible characteristics would be stiffness or noticeable compression and product pooling on the surface.

Figure 5:
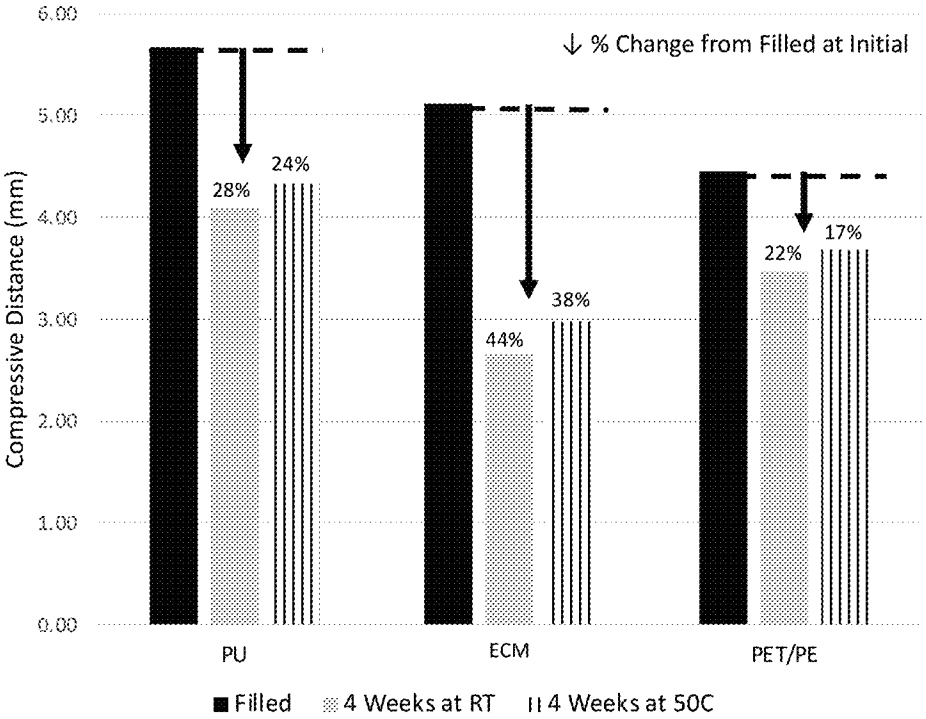
FIG. 5 depicts compatibility compression with 6 N application force according to an embodiment of the present disclosure.

Compatibility samples of each material were tested for compression with 6 N application force after conditioning. These results were compared to the initial compression results. FIG. 5 depicts comparisons of compatibility compression with 6 N application force according to an embodiment of the present disclosure. More specifically, the compressive distance (mm) for samples (PU, ECM, PET/PE) were compared from the time that they were filled, 4 weeks after filling at room temperature, and 4 weeks at 50° C. As reflected in FIG. 5, the percentage change from initial filling to 4 weeks at both room temperature and 50° C. is less for the PET/PE material when compared to the PU material and ECM. Accordingly, these results reflect that the PET/PE material may perform consistently throughout the product lifetime.

Filling efficiency is important for production with the cosmetic cushion selected. Objective machine parameters observed while filling material include, but are not limited to, piston speed, press time, and up delay. Table 2 shows how these parameters increase/decrease for PU material versus PET/PE material according to embodiments of the present disclosure. As reflected in Table 2, PET/PE material increases piston fill speed and up delay and decreases press time; these parameters reflect that PET/PE material according to embodiments of the present disclosure fills faster than PU material.

TABLE 2

| Objective Machine Parameters | | | |
|---|---|---|---|
| Material | Piston Fill Speed | Press Time | Up Delay |
| PU | ↓ | ↑ | ↓ |
| ECM | ↑ | ↓ | ↑ |
| PET/PE | ↑ | ↓ | ↑ |

Figure 10:
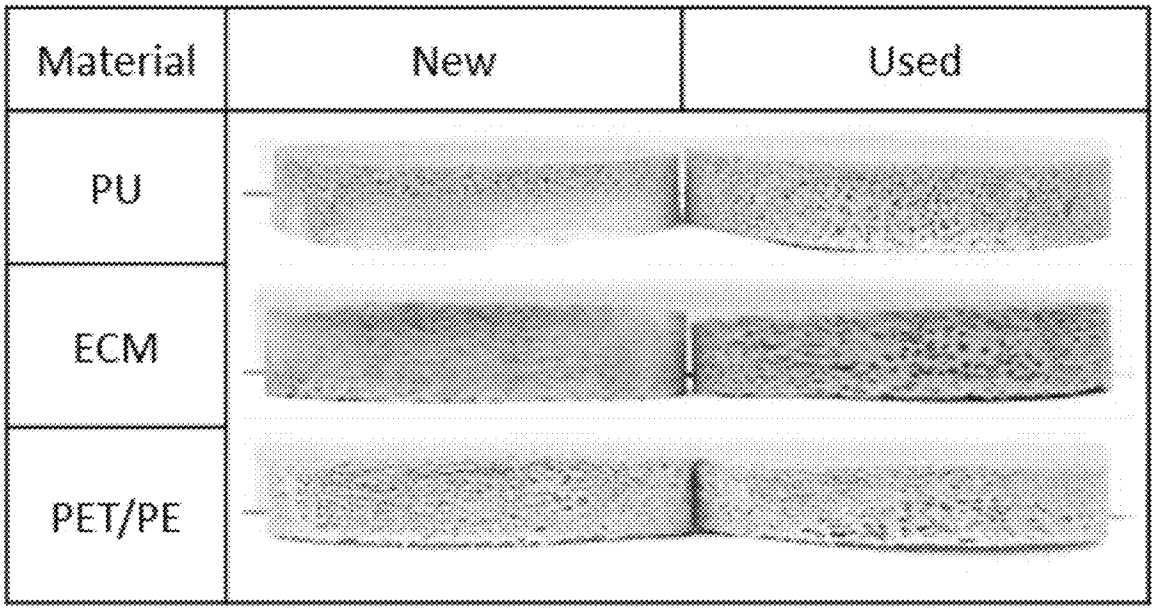
FIG. 10 depicts simulated customer use differences between used material and filled, unused material (new).

Product payoff by application force and before and after use material comparison were evaluated through simulated consumer use of cosmetic cushions. Product was evacuated from cushion material formed of PU material as well as ECM (a non-microfiber material) and PET/PE material. FIG. 10 reflects the difference between used material and filled, unused material (new).

As depicted in FIG. 10, PU material thickness remained comparable while the ECM became slightly compressed from use and never fully recovered. The force applied to evacuate product from cushion material increased with consumer use, as less product remained in the substrate. On average, the force applied to the ECM was greater than the PU material with less product payoff. However, there was no significant difference between ECM and PET/PE material texture and appearance after the first application and 100/200/300 pressings through central location testing.

Figure 6:
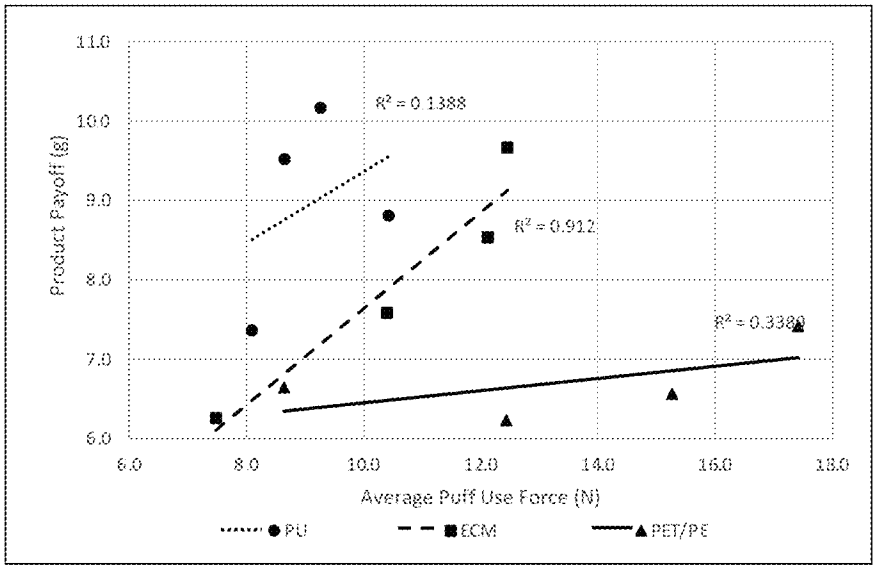
FIG. 6 depicts product payoff by puff application force according to an embodiment of the present disclosure.

FIG. 6 depicts product payoff (g) by puff application force (N) for PU material, PET/PE material, and ECM according to an embodiment of the present disclosure. As reflected in FIG. 6, PET/PE material had consistent product loading throughout use, while the PU material had greater variation.

Figure 7:
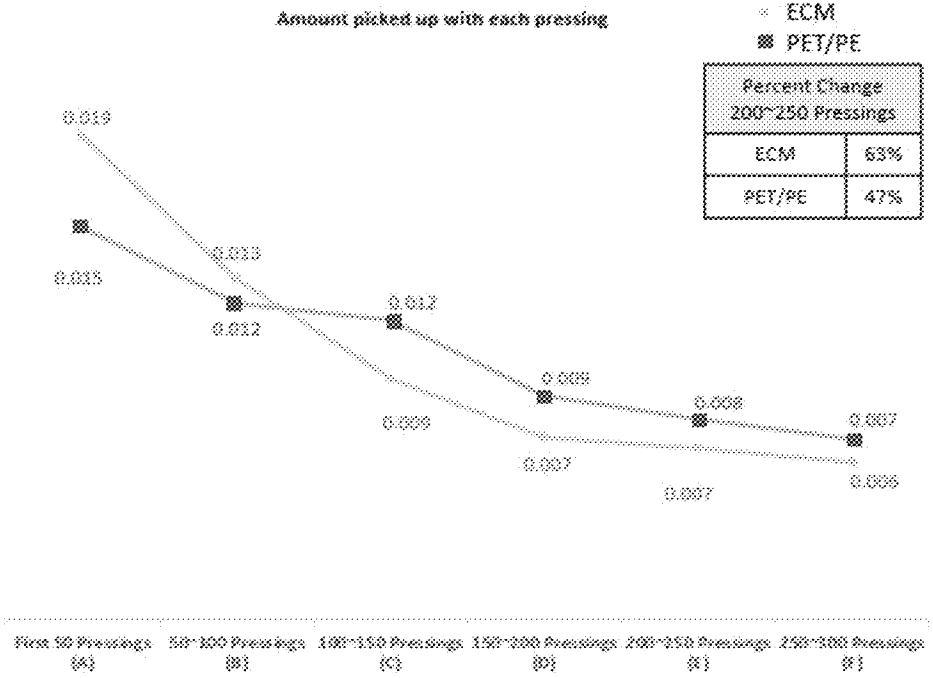
FIG. 7 depicts a graphical comparison of amount picked up with each pressing through central location testing according to an embodiment of the present disclosure.

FIG. 7 depicts a graphical comparison of ECM to PET/PE material with respect to the amount picked up with each pressing through central location testing according to an embodiment of the present disclosure. As reflected herein, throughout use, the product pick-up is more consistent for the PET/PE material (47% change over 200-250 pressings) when compared to ECM (63% change over 200-250 pressings). This was consistent with simulated consumer use testing results. Accordingly, consumers will feel consistent performance throughout the product life cycle with cushions formed of PET/PE material according to embodiments of the present disclosure compared to PU material or ECM.

Figure 9:
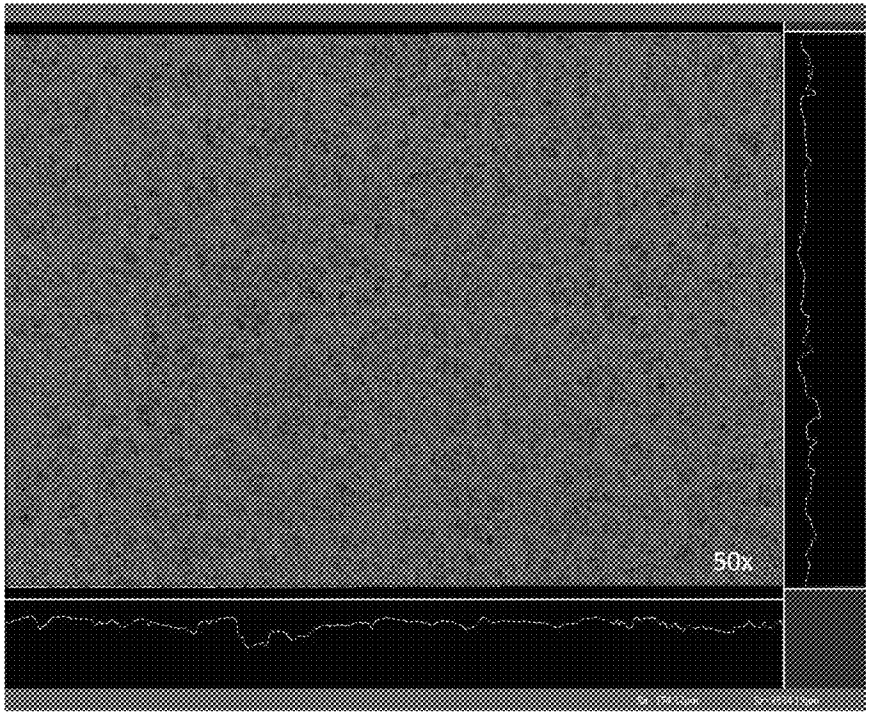
FIG. 9 depicts Sa testing for a PET/PE material according to an embodiment of the present disclosure.
Figure 8:
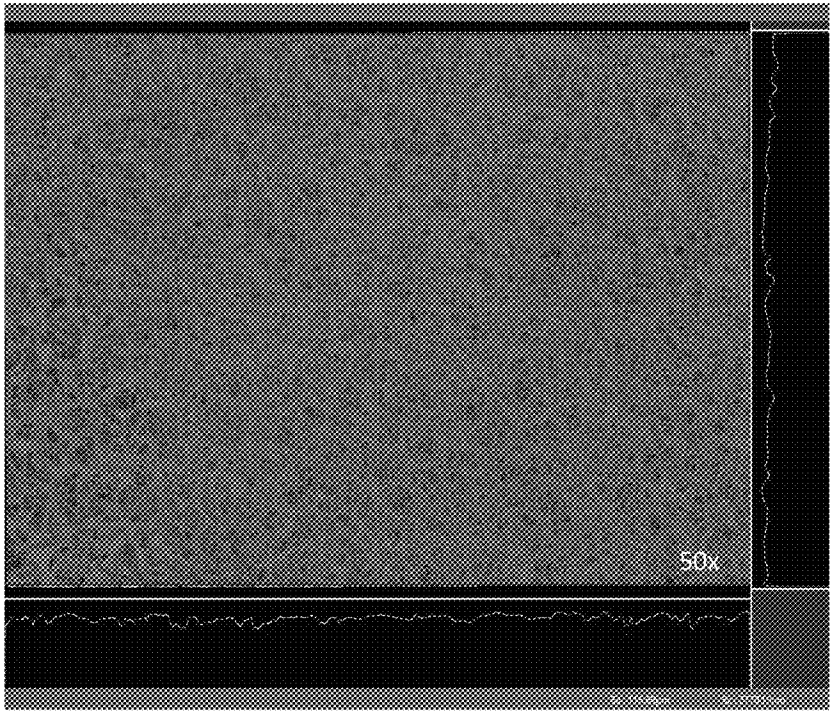
FIG. 8 depicts Sa testing for an ECM.

Further testing confirmed that a cushion formed of PET/PE material according to embodiments of the present disclosure exhibited a greater average value of height at each point within the defined area (Sa) (FIG. 8) compared to a cushion formed of ECM (FIG. 9) (174.32 μm versus 116.69 μm). The peaks and valleys were more predominant, which is observed to reduce product loading. This testing was further confirmed through consumer use studies.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A cosmetic cushion to hold a cosmetic composition, the cushion comprising:

a nonwoven material formed of bicomponent fibers having a fiber diameter range of 18-30 μm, a density of 20-35 kg/m$^3$, and a sorptivity of 0.09+/−0.05 g/m$^2$t$^5$, the bicomponent fibers formed by carding, cross-lapping, and/or bonding methods selected from thermal bonding, needle punching, and/or hydroentangling, wherein distribution of the cosmetic composition on the cosmetic cushion formed of the nonwoven material remains more stable throughout use compared to a cushion formed of non-microfiber.

2. The cosmetic cushion of claim 1, the bicomponent fibers selected from the group comprising:

a polyethylene terephthalate (PET) core/polyethylene (PE) shell composition, a polypropylene (PP)/polypropylene (PP) composition, a polypropylene (PP)/polyethylene (PE) composition, a polyethylene terephthalate (PET)/polypropylene (PP) composition, and blends thereof.

3. The cosmetic cushion of claim 1, the bicomponent fibers comprising:

a polyethylene terephthalate (PET) core/polyethylene (PE) shell composition.

4. The cosmetic cushion of claim 3 having a compressive distance by application of 6 N force that is approximately the same for a dry cushion as with a cushion filled with the cosmetic composition.

5. The cosmetic cushion of claim 1, the nonwoven material formed at least in part of fibers from virgin resin or recycled resin.

6. The cosmetic cushion of claim 1 having a thickness of approximately 2 mm-20 mm.

7. The cosmetic cushion of claim 1 having a diameter of approximately 20-100 mm.

8. The cosmetic cushion of claim 1, wherein the density and the fiber diameter of the nonwoven material are lower than a cosmetic cushion formed of non-microfiber.

9. The cosmetic cushion of claim 1, wherein the density of the nonwoven material is higher than a cosmetic cushion formed of polyurethane.

10. The cosmetic cushion of claim 1, wherein the sorptivity of the nonwoven material is higher than a cosmetic cushion formed of non-microfiber.

11. The cosmetic cushion of claim 1 further comprising:

one or more binder fibers added to the nonwoven material.

12. A cosmetic cushion to hold a cosmetic composition, the cushion comprising:

a nonwoven material formed of bicomponent fibers having a polyethylene terephthalate (PET) core/polyethylene (PE) shell composition having a fiber diameter range of 18-30 μm, the nonwoven material having a density of 20-35 kg/m$^3$ and a sorptivity of 0.09+/−0.05 g/m$^2$t$^5$, the bicomponent fibers formed by carding, cross-lapping, and/or bonding methods selected from thermal bonding, needle punching, and/or hydroentangling.

13. The cosmetic cushion of claim 12, wherein distribution of the cosmetic composition on the cosmetic cushion formed of the nonwoven material remains more stable throughout use compared to a cushion formed of non-microfiber.

14. The cosmetic cushion of claim 12, wherein the density and the fiber diameter of the nonwoven material are lower than a cosmetic cushion formed of non-microfiber.

15. The cosmetic cushion of claim 12, wherein the density of the nonwoven material is higher than a cosmetic cushion formed of polyurethane.

16. The cosmetic cushion of claim 12, wherein the sorptivity of the nonwoven material is higher than a cosmetic cushion formed of non-microfiber.

17. A cosmetic cushion to hold a cosmetic composition, the cushion comprising:

a nonwoven material formed of bicomponent fibers formed by carding, cross-lapping, and/or bonding methods selected from thermal bonding, needle punching, and/or hydroentangling, the bicomponent fibers selected from selected from the group comprising:

a polyethylene terephthalate (PET) core/polyethylene (PE) shell composition, a polypropylene (PP)/polypropylene (PP) composition, a polypropylene (PP)/polyethylene (PE) composition, a polyethylene terephthalate (PET)/polypropylene (PP) composition, and blends thereof, the nonwoven material having a density of 20-35 kg/m$^3$ and a sorptivity of 0.09+/−0.05 g/m$^2$t$^5$, wherein the cosmetic cushion has a compressive distance by application of 6 N force that is approximately the same for a dry cushion as with a cushion filled with the cosmetic composition.

18. The cosmetic cushion of claim 17, wherein the density and a fiber diameter of the nonwoven material are lower than a cosmetic cushion formed of non-microfiber, and wherein the sorptivity of the nonwoven material is higher than a cosmetic cushion formed of non-microfiber.

* * * * *